US008225828B2

(12) United States Patent
Greiner

(10) Patent No.: US 8,225,828 B2
(45) Date of Patent: Jul. 24, 2012

(54) MODULAR CONICAL CHIPPER/CANTER HEAD AND METHOD

(75) Inventor: John P. Greiner, Oregon City, OR (US)

(73) Assignee: Key Knife, Inc., Tualatin, OR (US)

( * ) Notice: Subject to any disclaimer, the term of this patent is extended or adjusted under 35 U.S.C. 154(b) by 633 days.

(21) Appl. No.: 11/637,501

(22) Filed: Dec. 11, 2006

(65) Prior Publication Data

US 2008/0135132 A1 Jun. 12, 2008

(51) Int. Cl.
*B27C 1/00* (2006.01)
*B27C 9/00* (2006.01)

(52) U.S. Cl. ..... 144/220; 144/370; 144/235

(58) Field of Classification Search ..... 144/223, 144/219, 220, 231, 235, 236, 39, 41, 37, 144/370; 83/837, 838, 835, 676; 241/91, 241/278.2, 32, 371
See application file for complete search history.

(56) References Cited

U.S. PATENT DOCUMENTS

| | | | | |
|---|---|---|---|---|
| 3,570,567 | A | 3/1971 | Hickman | |
| 4,082,127 | A | 4/1978 | Miller | |
| 4,456,045 | A * | 6/1984 | Gregoire | 144/373 |
| 4,793,390 | A | 12/1988 | Stroud | |
| 4,984,614 | A * | 1/1991 | Landers et al. | 144/220 |
| 5,063,980 | A * | 11/1991 | Schultz | 144/223 |
| 5,511,597 | A * | 4/1996 | Shantie et al. | 144/220 |
| 5,613,538 | A * | 3/1997 | Brisson | 144/228 |
| 5,709,255 | A * | 1/1998 | Toogood | 144/220 |
| 5,816,301 | A * | 10/1998 | Stager | 144/228 |
| 5,819,826 | A | 10/1998 | Schmatjen | |
| 5,983,967 | A * | 11/1999 | Gross et al. | 144/235 |
| RE36,659 | E * | 4/2000 | Toogood | 144/220 |
| 6,167,929 | B1 | 1/2001 | Stager et al. | |
| 6,227,267 | B1 * | 5/2001 | Michell et al. | 144/220 |
| 6,543,497 | B2 * | 4/2003 | Dietz | 144/373 |
| 6,637,483 | B2 * | 10/2003 | Stager et al. | 144/373 |
| 6,662,837 | B2 * | 12/2003 | Smith | 144/241 |
| 6,688,351 | B2 * | 2/2004 | Stager et al. | 144/373 |
| 6,772,810 | B1 * | 8/2004 | Bouchard et al. | 144/220 |

(Continued)

FOREIGN PATENT DOCUMENTS

| | | |
|---|---|---|
| DE | 195 13 699 | 11/1995 |
| WO | WO 03/064126 A1 | 11/2002 |

OTHER PUBLICATIONS

PCT, International Search Report regarding PCT/US2007/024950, Mar. 12, 2008.
HewSaw—"The Evolution of Chipper Heads," HewSaw Team; The Veisto Group Magazine No. 1—2005. Publisher: Veisto Oy.

*Primary Examiner* — David J. Walczak
*Assistant Examiner* — Jennifer C Chiang
(74) *Attorney, Agent, or Firm* — Portland Intellectual Property, LLC

(57) ABSTRACT

A modular conical chipper/canter head and method. A preferred method adjusts the cutting head for changes in chip length. The method includes the steps of providing an annular facing module, providing a conical, solid hub module for mounting one or more chipping knives, and at least one of (a) installing one or more control plates between the facing module and the hub module, and (b) removing the one or more control plates from between the facing module and the hub module, for spacing the facing and hub modules apart a selected amount.

10 Claims, 7 Drawing Sheets

U.S. PATENT DOCUMENTS 6,915,971 B2 * 7/2005 Pallmann ..... 241/91
6,923,227 B2 * 8/2005 Robitaille ..... 144/176
6,938,656 B2 * 9/2005 Plouffe et al. ..... 144/220
7,404,421 B2 * 7/2008 Guels ..... 144/220
7,441,571 B2 * 10/2008 Stager et al. ..... 144/162.1
2003/0070728 A1 * 4/2003 Plouffe et al. ..... 144/220
2004/0250898 A1 12/2004 Rautio
2005/0166998 A1 8/2005 Biller

* cited by examiner

MODULAR CONICAL CHIPPER/CANTER HEAD AND METHOD

FIELD OF THE INVENTION

The present invention relates to a conical chipper/canter head, such as is typically employed for cutting and chipping logs in a sawmill, for processing the logs into lumber for use in construction.

BACKGROUND

In sawmills, logs are cut into slab sided articles of wood in the process of converting the logs into useable lumber. For this purpose, the log is fed into a device referred to as a chipper or canter (hereinafter "chipper/canter"). The chipper/canter has a rotating cutting head incorporating a plurality of cutting members, typically removable knives, saws, or combinations thereof. The cutting head is variously referred to as a chipper head, canter head, slabbing head, or conical head. The term "chipper" refers to one function of the chipper/canter, i.e., to produce chips that are used to form other wood products, such as pulp, paper, and particle board. The term "canter" refers to another function of the chipper/canter, i.e., to cut a piece from the log, referred to as a "cant," having at least two parallel, substantially flat or slab sides, and the term "slabbing" refers to producing one or more of these sides. All of these heads are termed "conical" heads due to their geometry; the cutting surface defined by rotation of the head is actually frustoconical in shape.

The cutting head rotates about its axis of symmetry and the log is translated toward the head in a direction that is aligned with the longitudinal axis of the log and perpendicular to the axis of rotation of the head, causing the log to interfere with the cutting surface of the head and thereby cutting the log to produce elongate, slab sided articles of wood, and chips.

There are typically two opposed cutting heads operating on the log at substantially the same time to produce, during one pass of the log, two sided cants, and often there are four cutting heads for producing four sided cants from the log in a single cutting operation.

As the cutting surface defined by the rotating conical cutting head is actually frustoconical, it includes a flat annular portion as well as a conical portion that flares outwardly from the annular portion. The plane of the annular portion of this cutting surface is in the plane of the slab sides of the articles of wood and produces a finish on these sides. However, the log first encounters the conical portion of the cutting surface of the rotating cutting head, which cuts and tears chips from the log in preparation for the finishing provided by the annular portion as translation of the log in the direction just indicated is continued.

The annular portion of the cutting surface defined by the rotating conical cutting head is typically produced either by a plurality of circumferentially spaced knives, or a disk-saw. Any such structure is referred to hereinafter as a "facing" portion of the cutting head because it produces a "facing" cut on the log that defines the slab sides of the lumber.

The conical portion of the cutting surface is typically produced by a plurality of staggered knives that are often arranged in spaced apart circular patterns, or alternatively in a spiral pattern, so as to trace a frustoconical surface as the head rotates. Any such structure is referred to hereinafter as a "chipping" portion of the cutting head because it cuts chips from the log.

It will be appreciated that a significant volume of the log must be removed as chips because the log is roughly circular and the lumber produced therefrom is rectilinear. So the chips are a waste product of the conversion of the log to lumber, but they are at the same time useful as constituents of manufactured wood products. They are particularly useful where their dimensions are controlled, and a dimensional parameter of the chip that is particularly important to control is the chip length.

The knives of the chipping portion are attached to a body of the head either directly or through intermediate members, and the body of the head may or may not itself be essentially frustoconical in shape. The body is often referred to in the art as "solid."

FIG. 1 shows schematically a log 2 being processed, i.e., cut, chipped, or sawn into lumber by a pair of opposed chipper/canter cutting heads rotating about an axis of rotation "L." Each cutting head includes chipping knives having cutting edges that define a chip cutting surface indicated as 3, and facing knives, or alternatively saw teeth, having cutting edges that define a face cutting surface indicated as 4. The cutting heads establish a depth of cut "d" between the slab sided faces "f" of the cut lumber, the location being indicated with a reference line "REF," and the original, curved outer surface "s" of the log.

To adjust the depth of cut, the heads are moved in and out, i.e., axially, in the direction of the arrows, in the direction of the axis of rotation L.

FIG. 2 shows a prior art cutting head 5 in isometric view, and FIG. 3 shows the same head looking down the axis "L," in the plane of head rotation. The conical chip cutting surface is 6 and the annular facing surface is 7. The chip cutting surface is defined by chipping knives 8, namely 8*a* and 8*b*, having cutting edges 9. The knives 8 are separated by an angular distance θ, and the head rotates at an angular velocity ω. Also shown is the log 2 about to be fed into the cutting head at a feed speed "v."

The chip length is the distance the log travels in the time that the head turns sufficiently to move a knife (e.g., 8*b*) into the same position that a preceding knife (e.g., 8*a*) was in. Thus the chip length is equal to $v \cdot \theta / \omega$.

A "limiter" structure 10 is typically provided between adjacent knives 8. The limiter has an outer surface (hereinafter "limiting surface") 10*a* that limits radial movement of the log, holding the log in place, to prevent or at least minimize surging and bucking. The limiting surface is, overall, at a somewhat lower radial elevation "r" than that of the adjacent knives, and in addition its radial elevation smoothly curvilinearly decreases over the angular distance between the adjacent knives from its elevation proximate the first knife to contact the wood, e.g., the knife 8*a*, to the next knife, e.g., the knife 8*b*. This change in radial elevation of the limiter surface is best seen in FIG. 4 (compare the radial elevations "$r_1$" and "$r_2$") showing the limiter surface by itself.

The amount of overall elevation drop, or "relief," provided for the limiting surfaces relative to the knife cutting edges is dictated by the same parameters that determine chip length. Therefore, adjusting the chip length requires changing this elevation. More particularly, decreasing the chip length, e.g., by decreasing the log feed speed or by increasing the angular velocity of the cutting head, requires increasing the radial elevation of the limiting surfaces, to move the limiting surfaces closer to the elevation of the cutting edges of the chipping knives.

The shape of the curve defining how the elevation of the limiting surfaces drops in-between adjacent knives is also dictated by the same parameters that determine chip length.

The limiter 10 as shown in FIGS. 2-4 is formed in a continuous ring which is not typical, though it best illustrates the aforementioned elevation variation. However, typically, the limiting surface is provided as discrete, modular limiter elements that are individually mounted between the associated chipping knives. In that case, adjustments require dismounting, repositioning or replacing, and finally re-mounting the limiter elements. As there are typically a number of the limiter elements, this is a time consuming procedure. While the continuous ring eliminates the need to individually adjust or replace a number of limiter elements to adjust chip length, the adjustment requires replacing the ring. Since there may be a number of different chip length adjustments required, this exacts a penalty in the cost and inconvenience of obtaining, storing, and maintaining a number of different rings.

Accordingly, an improved chipper/canter head of modular design according to the present invention provides for quicker and easier adjustment of chip length, as well as other advantages.

SUMMARY

A modular conical chipper/canter head and method is disclosed herein. A preferred method is described for adjusting the head to accommodate a change in chip length. The method includes the steps of providing an annular facing module, providing a conical, solid hub module for mounting one or more chipping knives, and at least one of (a) installing one or more control plates between the facing module and the hub module, and (b) removing the one or more control plates from between the facing module and the hub module, for spacing the facing and hub modules apart a selected amount.

A preferred modular chipper/canter head includes an annular facing module and a conical, solid hub module for mounting one or more chipping knives. The facing module includes one or more limiters providing a limiting surface corresponding to the one or more chipping knives. The limiting surface intersects a plane which is perpendicular to the axis of rotation of the cutting head and which also intersects the one or more chipping knives. The facing module and the hub module are adapted to be detachably mounted to each other. Preferably, one or more control plates are utilized for spacing the facing module and the hub module apart.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Reference will now be made in detail to specific preferred embodiments of the invention, examples of which are illustrated in the accompanying drawings.

Figure 5:
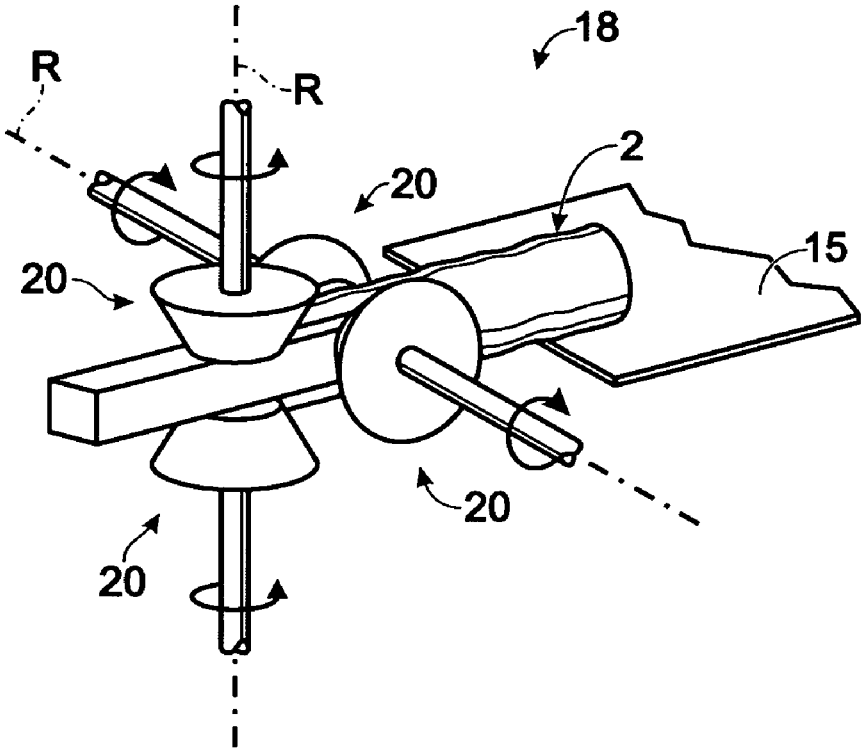
FIG. 5 is a schematic isometric view of a wood cutting system in which four instances of a modular conical chipper/canter head according to the present invention are provided for chipping and facing a log.

FIG. 5 shows a wood cutting system 18 in which one or more instances of a modular conical chipper/canter cutting head 20 ("cutting head") according to the present invention may be used, four orthonormally disposed cutting heads 20 being indicated as would be typical. The system 18 would typically be provided in a sawmill for cutting raw logs, such as the log 2, and and processing the logs into lumber. However, it should be understood that while the cutting head 20 would typically be used for cutting lumber from logs, the cutting head 20 may be used to cut substantially plane surfaces from any other material or object desired.

The system 18 has an in-feed table 15 for supporting the log 2, which travels horizontally on the table. As a result of rotation of the cutting heads 20 about respective axes of rotation "R," (the directions shown are arbitrary), in conjunction with travel of the log 2 relative to the cutting heads in a direction "T" aligned with the elongate axis of the log, each cutting head cuts a corresponding planar surface on the log.

Figure 6:
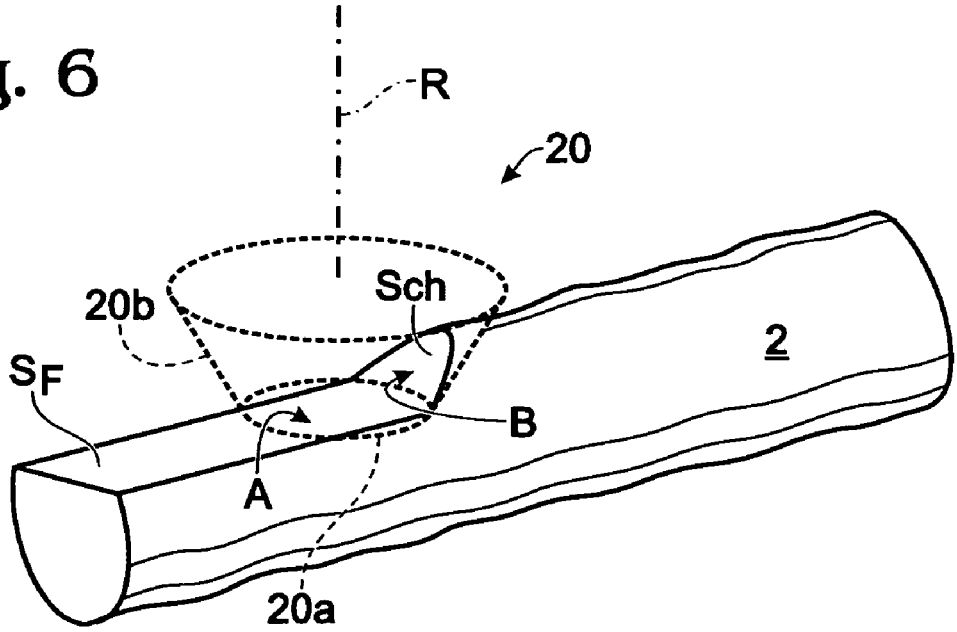
FIG. 6 is a schematic isometric view of one of the cutting heads of FIG. 5 chipping and facing the log.

FIG. 6 shows a log as it is being cut by one of the heads 20. The cutting head 20 has a facing portion 20*a* and a chipping portion 20*b*. The facing portion 20*a* produces facing cuts on the log in the region "A" to produce the substantially planar facing surface "$S_F$," and the chipping portion 20*b* cuts chips from the log in the region "B," which produces a relatively rough, substantially conically shaped chipped surface "$S_{CH}$."

Figure 7:
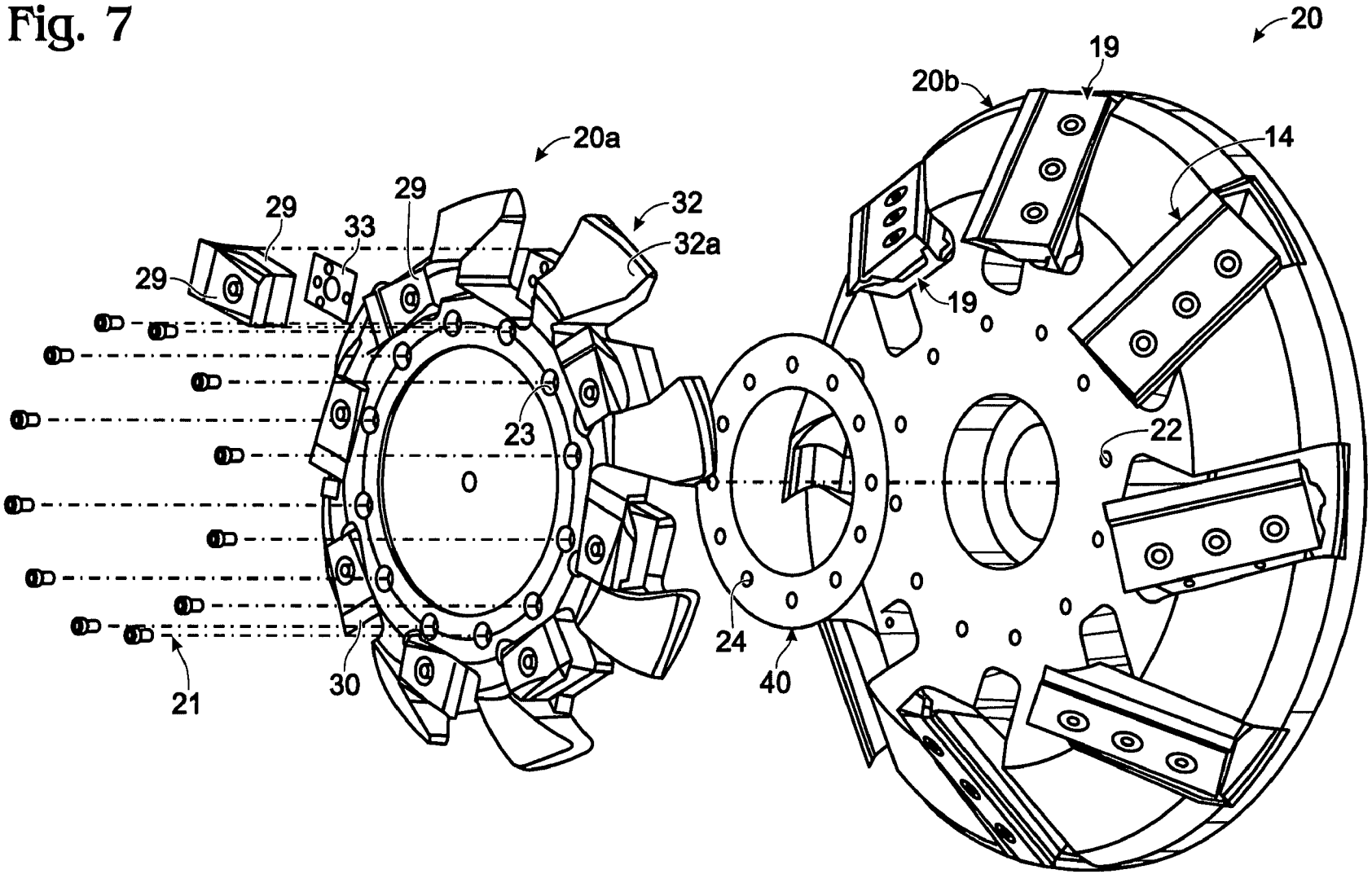
FIG. 7 is an exploded isometric view of a preferred modular conical chipper/canter head according to the present invention.

FIG. 7 shows the preferred cutting head 20 exploded for clarity. The cutting head 20 is modular in that the facing portion 20*a* is provided as a unit, the chipping portion 20*b* is provided as a separate unit. The two units, or modules, are removably mounted together, such as by the use of mounting bolts 21, to provide a complete conical cutting head. However, it would be possible to use each of the modules 20*a* and 20*b* alone, since they are detachable and provide separate functions. The chipping portion 20*b* will be referred to hereinafter as a "hub" using industry parlance, and would be further classified in the industry as being "conical," and "solid."

The hub 20*b* includes a plurality of chipping knives 14, though it should be understood that a single knife could in principle be used. Each knife is clamped by one or more removably mounted clamping members 19 to the hub. The clamping members typically comprise upper and lower portions for clamping the knives 14 between the upper and lower portions, but clamping members may be single portions that clamp the knives directly to the hub 20*b*. Discussion of the details of the clamping members is omitted as such clamps are well known in the art, and any known clamping methodology could be used. The hub includes holes 22 for receiving the mounting bolts 21.

The facing portion 20*a* will be referred to hereinafter as a "faceplate." The faceplate is substantially annular, as contrasted with the substantially frustoconical configuration of the hub 20*b*. Neither the terms "annular" nor "conical" are intended to be strictly construed.

The faceplate 20*a* preferably includes a plurality of facing knives 30, each clamped by a corresponding one or more clamping members 29 to the faceplate, though it should be understood that a single facing knife, or a saw-blade or plurality of saw-blade segments, could be used. As for the clamping members 19 of the hub 20*b*, the clamping members typically comprise upper and lower portions for clamping the knives 30 between the upper and lower portions, but clamping members may be single portions that clamp the knives directly to the hub 20*a*. The faceplate includes holes 23 for receiving the mounting bolts 21.

The faceplate 20*a* further includes one or more limiting structures (together hereinafter "limiter") 32. The limiter 32 defines a limiting surface 32*a* that is associated with each chipping knife 14 of the hub 20*b*. The limiting surface 32*a* establishes a limit on the radial movement of the log as mentioned above.

It will be understood that, where there are a plurality of chipping knives as is standard practice, the limiting surface or a portion thereof is disposed angularly between adjacent chipping knives as shown.

The limiter 32 is preferably provided integrally with the faceplate 20*a* as shown, but it may be separately removably attached to the faceplate, e.g., by bolts, or it may be provided, either integrally with or removably attached to, segments which themselves may be removably attached to the faceplate. In any case, it is an outstanding feature of the invention that all of the facing knives 30, as well as the limiter 32, may be removed from the hub 20*b* together as a modular unit, simply by removing the mounting bolts 21.

Moreover, one or more "control plates" 40 are preferably provided according to the invention. A control plate is generally a spacing element that is specially adapted for spacing two particular parts relative to each other a selected, controlled amount. It will have at least two holes for receiving bolts used to mount the parts together and is therefore installed or removed into or from a position between the parts by dismounting the parts. The control plate has a thickness in the range 0.040" to 0.250," and more preferably in the range 0.060"-0.125". Since the control plate is used in a manufacturing environment, it should be sturdy enough to withstand ordinary abuse without deforming or tearing, and it is believed that if provided to be at least 0.040" thick, and preferably at least 0.060" thick, this objective will be met. The thickness of different control plates used for spacing the same parts may vary within the defined ranges.

FIG. 7 shows a control plate 33 for installation between the clamping members 29 and the faceplate 20*a* to adjust the axial position of the facing knives, and therefore the position of the facing cut.

The ability to remove the faceplate 20*a* as a unit from the hub 20*b* provides the capability to use one or more of the control plates 40 to advantage. The control plates allow adjustment, in discrete increments, of the axial position of the faceplate relative to the hub 20*b*. Providing for this, the control plates 40 have holes 24 corresponding to the holes 23 of the faceplate 20*a* and the holes 22 of the hub 20*b*, for receiving the bolts 21.

Axial adjustment of the faceplate relative to the hub axially adjusts the limiter 32, which is carried by the faceplate, relative to the chipping knives 14, which are carried by the hub. The present inventor has recognized that this effectively provides for radial elevation adjustment of the limiter 32, enabling quick and easy adjustment of the limiting surface for changes in chip length.

Figure 8:
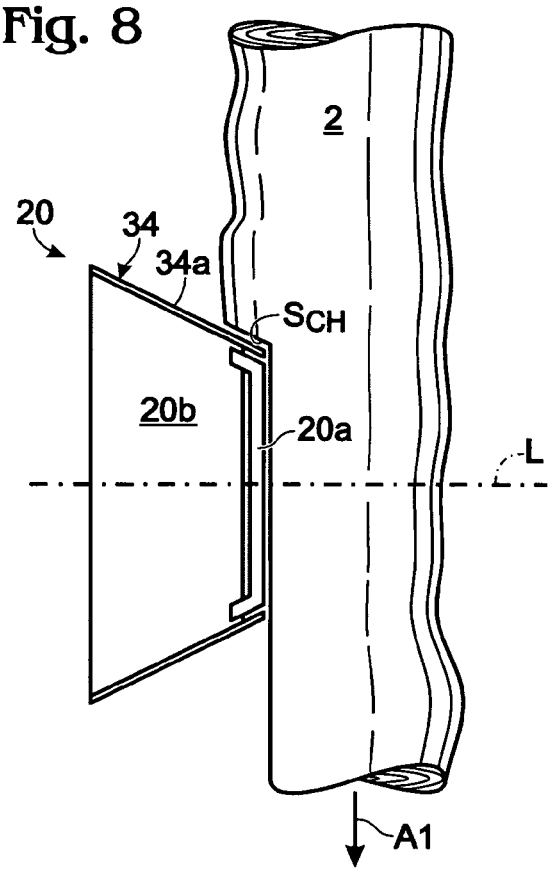
FIG. 8 is schematic plan view of a single modular chipper/canter head according to the present invention chipping and facing a log.

FIG. 8 shows, schematically, one cutting head 20 cutting a log 2. The log is fed in the direction "A1" and the cutting head turns about axis L, perpendicular to A1. The cutting head 20 is shown with the faceplate 20*a* and hub 20*b*. The hub 20*b* carries a chipping knife 14 having a cutting edge 14*a*. The cutting edge 14*a* forms the chipped surface $S_{CH}$.

Figure 9:
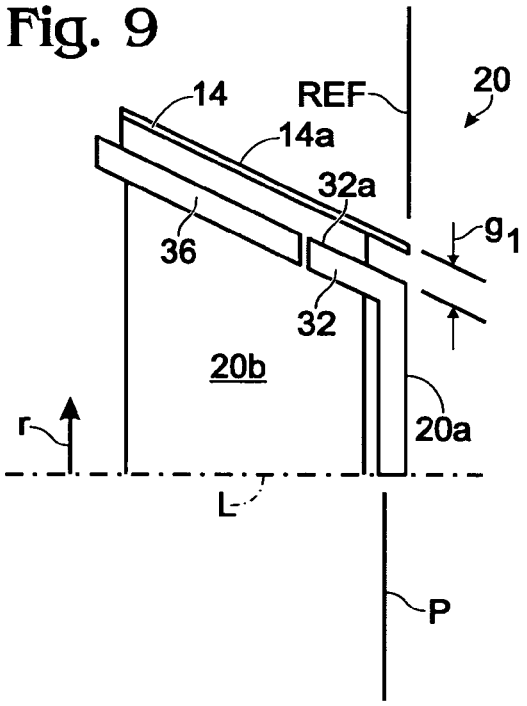
FIG. 9 is a schematic, plan view of the cutting head of FIG. 8 showing a first relative axial position of faceplate and hub according to the present invention.

FIG. 9 shows, schematically, the upper half of the cutting head 20 as it is seen in FIG. 8. The faceplate 20*a* and the hub 20*b* carry respective limiters, referenced as 32 and 36, respectively. The limiters have their ordinary functions; however, the limiter 36 of the hub is not considered, for purposes herein, particularly important, because the depth of cut is typically such that the limiter 36 does not come into contact with the log. The limiter 32 has an outer, limiting surface 32*a* which establishes a limit on the radial movement of the log as mentioned above.

Figure 1:
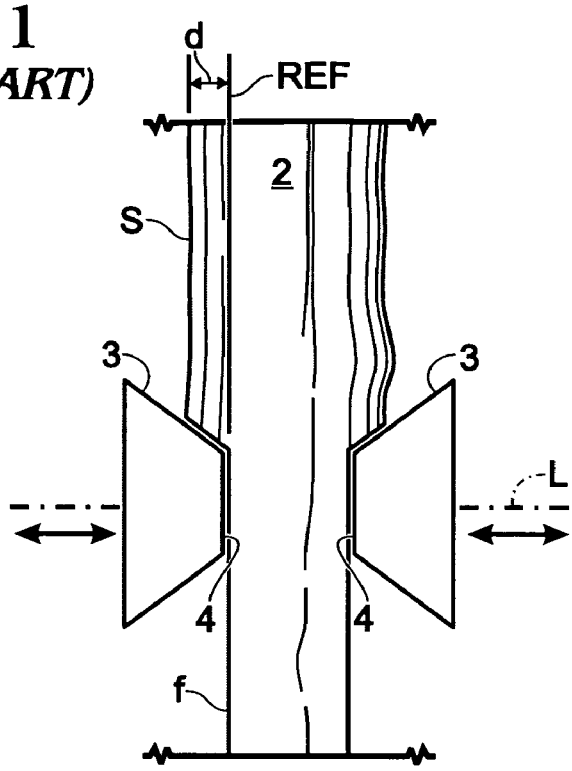
Fig. 1 (PRIOR ART)
FIG. 1 is a schematic plan view a log being processed into lumber by a generalized pair of opposed chipper/canter cutting heads.
Figure 4:
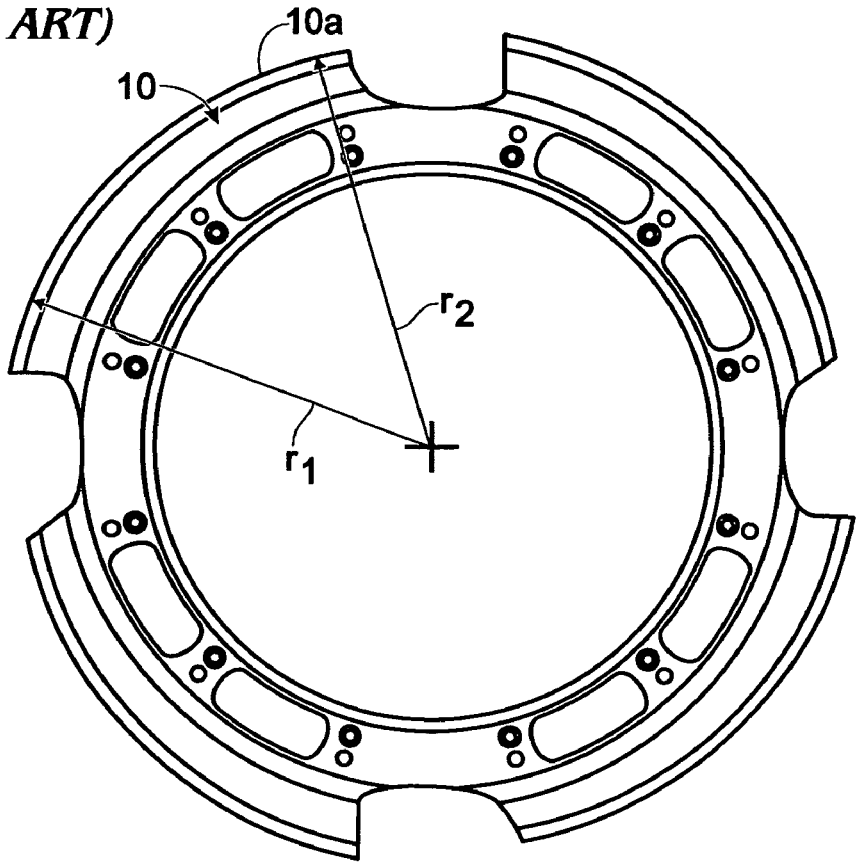
Fig. 4 (PRIOR ART)
FIG. 4 is a front view of a limiter portion of the cutting head of FIG. 2, shown removed from the cutting head.
Figure 2:
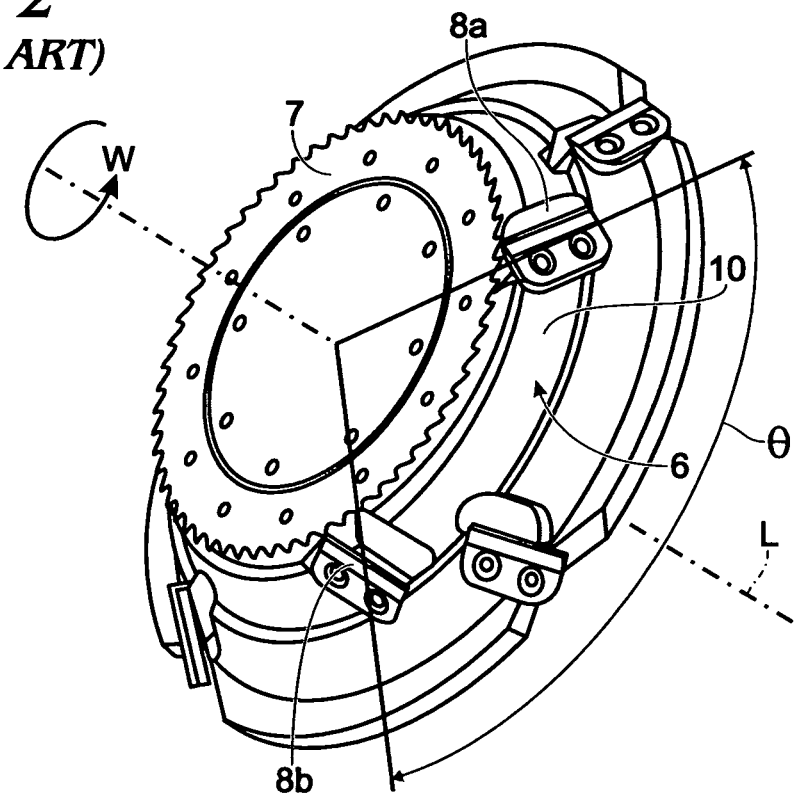
Fig. 2 (PRIOR ART)
FIG. 2 is an isometric view of a prior art cutting head.
Figure 3:
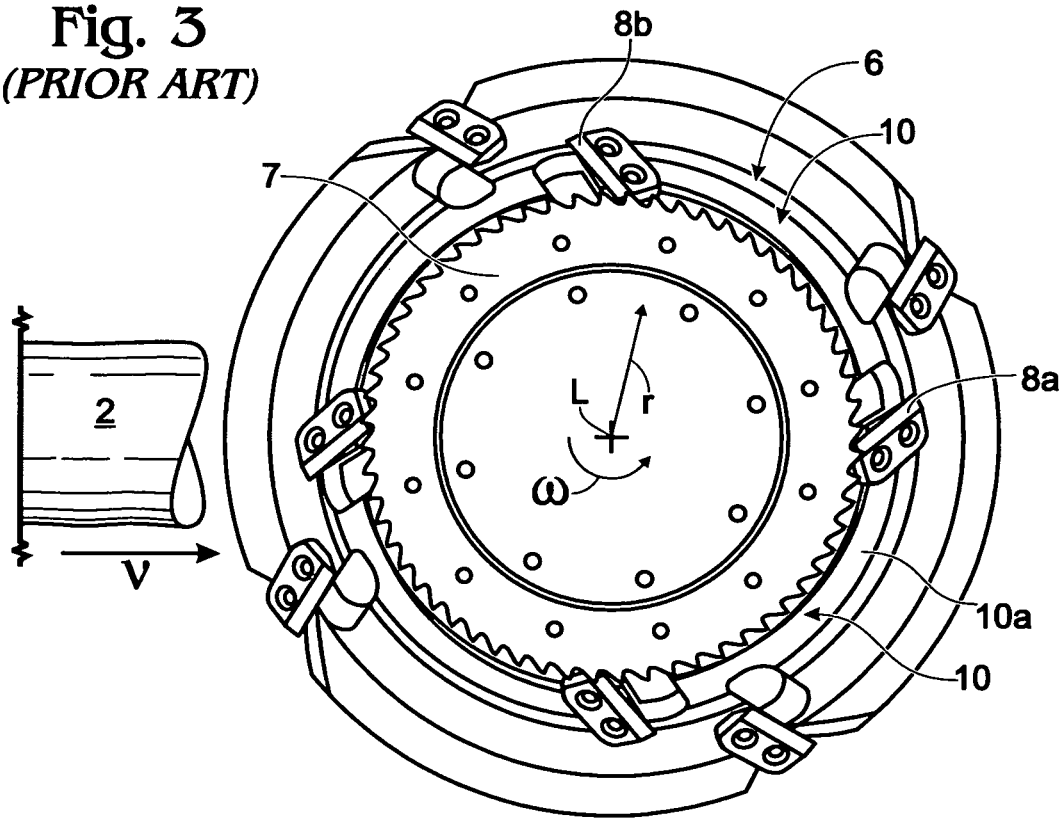
Fig. 3 (PRIOR ART)
FIG. 3 is a front view of the cutting head of FIG. 2.

A reference line "REF" is shown that indicates the location of the face cutting surface of the cutting head. The same reference line is shown in FIG. 1. Also, a plane "P" is shown in side elevation that intersects both the chipping knife 14 and the limiting surface 32*a*.

Figure 10:
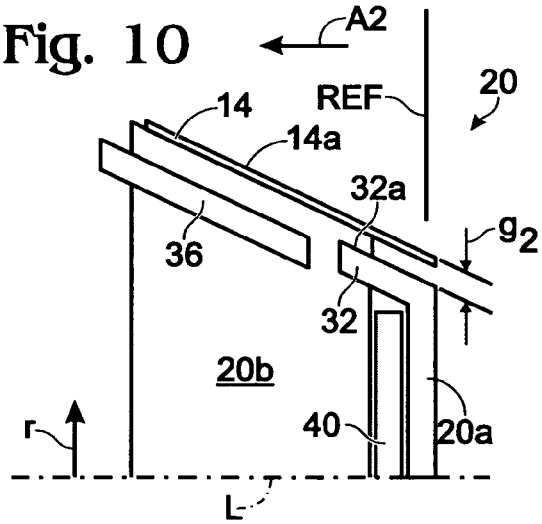
FIG. 10 is a schematic, plan view like FIG. 9 showing a second relative axial position of the faceplate and hub.

FIG. 10 shows the same half-section of the cutting head 20 as shown in FIG. 9, with a control plate 40 inserted between the faceplate 20*a* and the hub 20*b*. Relative to the reference line REF, the hub 20*b* must move back, away from the face cutting surface, in the direction "A2" by an amount equal to the thickness of the control plate. To provide for this movement, the cutting head is caused to be axially repositioned as if a depth of cut adjustment is being made. To compensate for this movement, the knife 14 is also slid toward the reference line REF so that it retains its original axial position relative to the reference line, as can be seen by comparing FIGS. 9 and 10.

Still comparing FIGS. 9 and 10, it can be seen that there is a gap "g," namely "$g_1$" (FIG. 9) and "$g_2$" (FIG. 10), between the cutting edge 14*a* of the chipping knife and the limiter 32, and that the gap has been decreased as a result of installation of the control plate 40. This difference in the gap g is effectively a change in the radial elevation r of the limiting surface provided by the limiter 32 relative to the chipping knives, and is appropriate for adjusting the limiting surface for a decrease in chip length even though the limiting surface has not moved relative to either the reference line REF or the axis of rotation L. To adjust the limiting surface for increasing chip length, i.e., to increase the gap g, one or more control plates that have already been installed can be removed.

Figure 11:
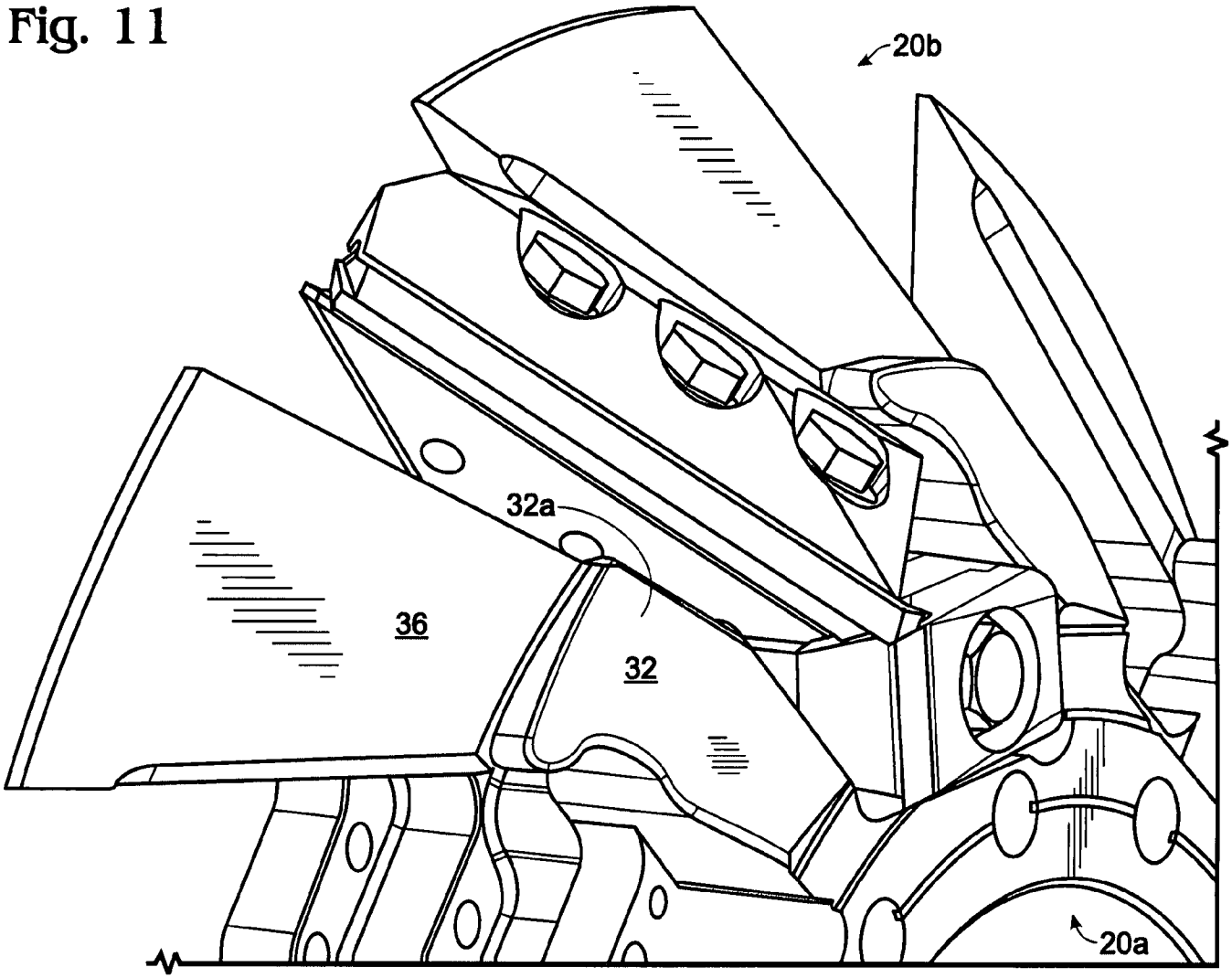
FIG. 11 is an isometric view of a preferred embodiment of the modular chipper/canter head with a faceplate and hub in a relative axial position corresponding to that shown in FIG. 9.
Figure 12:
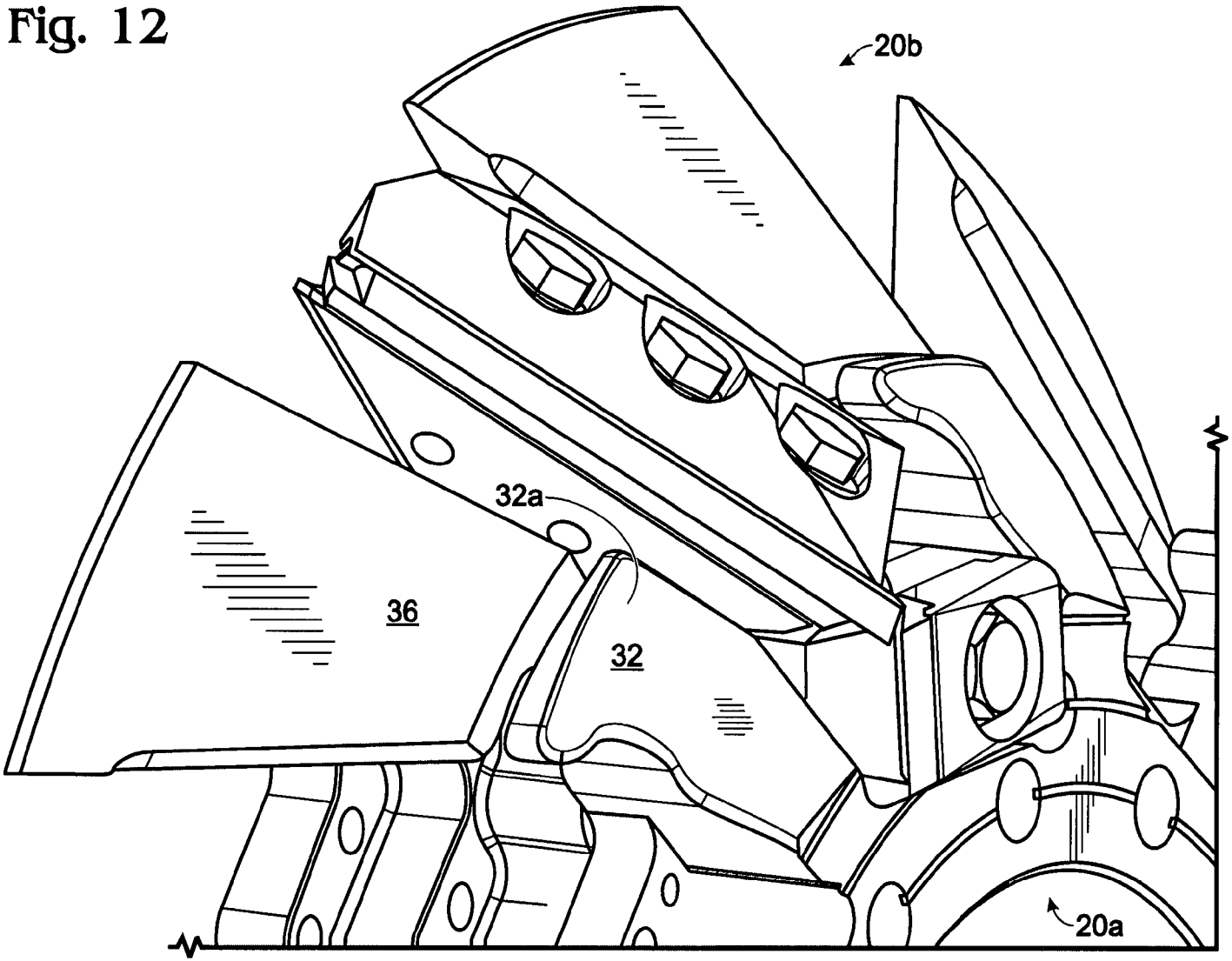
FIG. 12 is an isometric view of the modular chipper/canter head of FIG. 11 with the faceplate and hub in a relative axial position corresponding to that shown in FIG. 10.

FIGS. 11 and 12 show the cutting head of FIG. 7 in two states of adjustment by use of the control plates 40, FIG. 11 corresponding to FIG. 9 and FIG. 12 corresponding to FIG. 10. FIG. 11 shows the faceplate 20*a* closely spaced to the hub 20*b*, which provides a wide gap g such as the value $g_1$ in FIG. 10. FIG. 12 shows the faceplate spaced out farther from the hub, which narrows the gap to the value $g_2$ of FIG. 10.

The relatively close spacing shown in FIG. 11 between the limiter 32 of the faceplate 20*a* and the limiter 36 of the hub 20*b*, resulting from the use of fewer control plates, results in the larger gap $g_1$ between the limiting surface 32*a* and the cutting edge 14*a* shown schematically in FIG. 9, and FIG. 12 corresponds to the smaller gap $g_2$ shown in FIG. 10.

The above-described mechanism for adjusting the limiting surface is simple, because it requires a minimum of manipulations of the cutting head, and it is economical because it does not require the purchase, storage and replacement of expensive or heavy parts. It therefore allows for quick and easy adjustment of chip length. Modular chipper/canter heads according to the present invention may be employed with any prior art chipping knife, and any prior art facing knife or saw.

It is to be understood that, while a specific modular conical chipper/canter head has been shown and described as preferred, other configurations and methods could be utilized, in addition to those already mentioned, without departing from the principles of the invention. It should be understood that there is no intention to indicate, in describing particular features in a particular combination, that all of the features must be present together in that combination to be in accordance with the invention. Rather, it should be understood that features may be omitted from the combinations shown to the extent that the remaining features having the relationships described herein are deemed useful.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A modular cutting head for rotating one or more chipping knives about an axis, the one or more chipping knives for making chipping cuts in an article and thereby producing chips from the article, the modular cutting head comprising:

an annular facing module; and a conical, solid hub module, wherein according to a first condition, said facing and hub modules are adapted to be detachably mounted in fixed positions relative to one another, concentric with the axis, and wherein according to a second condition, said hub module is adapted for detachably mounting the one or more chipping knives at angularly spaced apart positions, so that an assembled configuration of the cutting head is defined wherein said hub and facing modules are mounted according to said first condition, and said one or more chipping knives are mounted to said hub module according to said second condition, said facing module carrying one or more limiters corresponding to one or more particular knife instances of the one or more chipping knives, defining a limiting surface for the particular knife instances which, in said assembled configuration of the cutting head, (a) intersects a reference plane which is perpendicular to the axis, where the reference plane also intersects the one or more knife instances, (b) is disposed between a first one of the knife instances to pass, as a result of rotation of the cutting head, a reference line lying in the reference plane and extending an arbitrary but fixed angle from the axis, and the next one of the knife instances to pass said reference line, and (c) has at least a portion that smoothly curvilinearly decreases in radial elevation measured from the axis, in the reference plane, from a maximum nearer said first knife instance to a minimum nearer said next knife instance, wherein, if there are a plurality of the chipping knives intersected by the reference plane, the knife instances include only those ones of the chipping knives that are in closest proximity to the limiting surface, measured in radial directions relative to the axis, said limiting surface thereby being effective for controlling radial movement of the article caused by contact between the article and the particular knife instances as a result of operation of the cutting head.

2. The cutting head of claim 1, wherein said facing module is adapted for mounting one or more facing knives.

3. The cutting head of claim 2, further comprising one or more control plates, for spacing said facing module and said hub module apart.

4. The cutting head of claim 3, wherein said one or more control plates include one or more holes for receiving respective fasteners.

5. The cutting head of claim 1, further comprising one or more control plates, for spacing said facing module and said hub module apart.

6. The cutting head of claim 5, wherein said one or more control plates include one or more holes for receiving respective fasteners.

7. A method for adjusting a cutting head that rotates about an axis for cutting an article to accommodate a desired change in the length of chips cut from the article, comprising:

providing an annular facing module for making facing cuts in the article;

providing a conical, solid hub module for mounting one or more chipping knives for making chipping cuts in the article and thereby producing the chips; and at least one of (a) installing one or more control plates between said facing module and said hub module, and (b) removing said one or more control plates from between said faceplate module and said hub module, for relatively axially repositioning said facing and hub modules, to adjust the cutting head to accommodate the desired change in the length of the chips.

8. The method of claim 7, wherein said facing module includes one or more limiters providing a limiting surface corresponding to said one or more chipping knives, said limiting surface both before and after said step of installing intersecting a plane which is perpendicular to said axis and which also intersects said one or more chipping knives.

9. The method of claim 8, further comprising axially repositioning said one or more chipping knives to compensate for said relative axial repositioning of said facing and hub modules, to maintain an axial spacing between cutting edges of said one or more chipping knives and the facing module.

10. The method of claim 7, further comprising axially repositioning said one or more chipping knives to compensate for said relative axial repositioning of said facing and hub modules, to maintain an axial spacing between cutting edges of said one or more chipping knives and the facing module.

* * * * *